US005727473A

United States Patent [19]

Engle

[11] Patent Number: 5,727,473

[45] Date of Patent: Mar. 17, 1998

[54] ROTARY LOCK FOR A SPLIT RAMP RAILWAY CAR

[75] Inventor: Thomas H. Engle, Cape Vincent, N.Y.

[73] Assignee: CSX Corporation, Richmond, Va.

[21] Appl. No.: 436,503

[22] Filed: May 8, 1995

[51] Int. Cl.[6] ..... B61G 5/00; B61D 47/00

[52] U.S. Cl. ..... 105/355; 105/238.1; 105/422; 105/454; 213/75 R; 292/341.17; 292/207

[58] Field of Search ..... 104/29, 30; 105/1.4, 105/157.1, 159, 176, 238.1, 363, 422, 454, 463.1; 213/7, 75 R, 184; 292/341.17, 207

[56] References Cited

U.S. PATENT DOCUMENTS

| | | | |
|---|---|---|---|
| 669,747 | 3/1901 | Heron | 213/184 |
| 2,381,633 | 8/1945 | Young | 292/341.17 |
| 4,158,996 | 6/1979 | Marulic et al. . | |
| 4,702,291 | 10/1987 | Engle | 105/35 |
| 4,783,102 | 11/1988 | Bernard | 292/341.17 |
| 5,222,443 | 6/1993 | Engle | 105/355 |
| 5,480,042 | 1/1996 | Engle | 105/355 |
| 5,520,489 | 5/1996 | Butcher et al. | 105/355 |

*Primary Examiner*—S. Joseph Morano

*Attorney, Agent, or Firm*—Finnegan, Henderson, Farabow, Garrett & Dunner, L.L.P.

[57] ABSTRACT

A rotary locking mechanism connects an upper ramp and a lower ramp of a split ramp railway car. A pin carrier supports a coupling pin and is mounted to the lower ramp by a swivel pin. The pin carrier can pivot horizontally relative to the lower ramp. A dual vertical rotor lock is mounted to the upper ramp. The rotor lock includes first and second coupling disks which have rotor slots or grooves for receiving the coupling pin. The coupling disks have a horizontal axis of rotation so that the disks are vertically mounted. The action of the coupling pin entering the grooves in the first and second coupling disks will automatically rotate the coupling disks into a locked position. Locking pins then engage slots in the peripheries of the coupling disks to secure the coupling disk in the locked position.

20 Claims, 14 Drawing Sheets

ROTARY LOCK FOR A SPLIT RAMP RAILWAY CAR

BACKGROUND OF THE INVENTION

A. Technical Field of the invention

The present invention relates generally to intermodal trains for transporting over-the-road vehicles or loads, and, more particularly, to a lock and coupler for a ramp car for such trains.

B. Discussion of the Related Art

An integral train is a train made up of a number of subtrains called elements. An example of an integral train is discussed in detail in U.S. Pat. No. 4,702,291 to Engle. The disclosure of U.S. Pat. No. 4,702,291 is incorporated into this specification by reference.

A ramp car used to load and unload an integral train is disclosed in U.S. Pat. No. 5,222,443 to Engle. The disclosure of U.S. Pat. No. 5,222,443 is incorporated into this specification by reference. The ramp car has a lowered loading position and a raised travel position. While in the raised position, the ramp car must be locked for travel.

The lock must be strong enough to hold the ramp together during travel, but should also be releasable under load. For example, even a grade of 1% or less can create large loads on the lock of a stationary ramp car which is part of an integral train. The action of the train's brakes on a stopped train can also create a load on a stationary ramp car by preventing the cars from moving closer together or further apart in order to relieve compression or tension loads between cars.

A lock should also be as compact as possible, and a simple design with as few mechanical parts as possible aids maintenance and manufacturing.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention includes a railway ramp car having a first wheel set and a second wheel set; a first ramp mounted to the first wheel set and a second ramp mounted to the second wheel set, at least one of the first and second ramps having a raised travel position and a lowered loading position; a pin carrier mounted on the first ramp, the pin carrier supporting a coupling pin having a horizontal axial direction; and a rotor lock mounted on the second ramp, the rotor lock comprising first and second coupling disks having grooves for receiving the coupling pin.

According to another aspect of the invention, the invention includes a railway ramp car having a first wheel set and a second wheel set; a first ramp mounted to the first wheel set and a second ramp mounted to the second wheel set, at least one of the first and second ramps having a raised travel position and a lowered loading position; a pin carrier supporting a coupling pin having a horizontal axial direction; means for pivotally mounting the pin carrier on the first ramp; and a rotor lock mounted on the second ramp, the rotor lock receiving the coupling pin and locking the first and second ramps together.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification illustrate embodiments of the invention and, together with the description, serve to explain the principles of the invention. In the drawings.

DETAILED DESCRIPTION OF THE PREFERRED EMBODIMENT

In accordance with the present invention, a rotary locking mechanism connects an upper ramp and a lower ramp of a split ramp railway car. A pin carrier supports a coupling pin and is mounted to the lower ramp by a swivel pin. The pin carrier can pivot horizontally relative to the lower ramp by a restricted amount. A dual vertical rotor lock is mounted to the upper ramp.

The rotor lock includes first and second coupling disks which have rotor slots or grooves for receiving the coupling pin. The coupling disks have a horizontal axis of rotation so that the coupling pin on the lower ramp may be horizontal. The horizontal mounting minimizes the coupling pin's intrusion into the restricted vertical space available for it. The action of the coupling pin entering the grooves in the first and second coupling disks will automatically rotate the coupling disks into a locked position. Locking pins then engage slots in the peripheries of the coupling disks to secure the coupling disk in the locked position.

Reference will now be made in detail to the present preferred embodiments of the invention, examples of which are illustrated in the accompanying drawings. Wherever possible, the same reference numbers will be used throughout the drawings to refer to the same or like parts.

Figure 1:
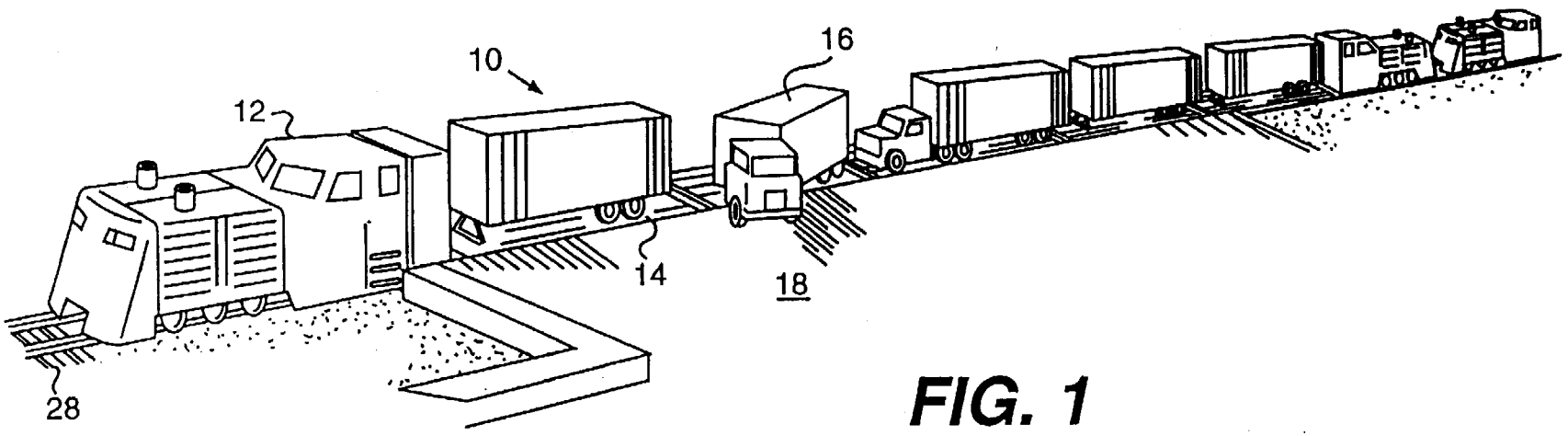
FIG. 1 is a perspective view of an integral train.

As shown in FIG. 1, integral train 10 may include a plurality of control cabs 12 and a plurality of cars 14. The cars may carry, for example, trailers 16. Trailer 16 may be unloaded at a special loading ramp 18. The loading ramps 18, however, may only exist at a select number of stations or stops and thus may be inconvenient to use. Additionally, cars 14 used with the loading ramp 18 require extra structure for side loading.

Figure 2:
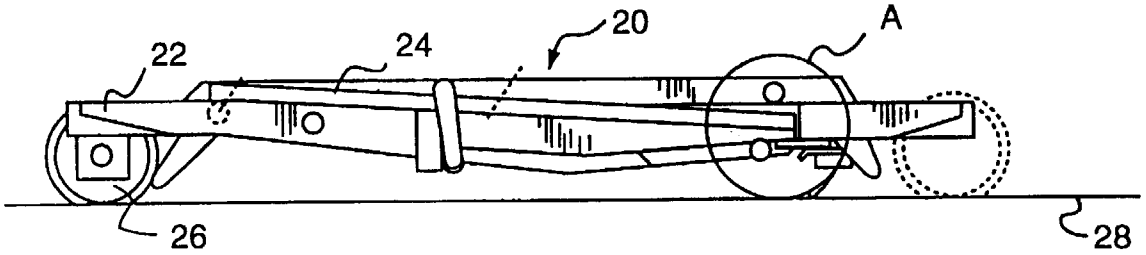
FIG. 2 is a side view of a railway ramp car for use in an integral train in a raised travel position.
Figure 3:
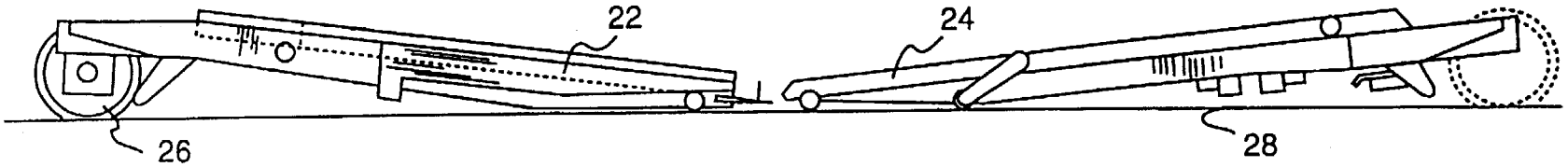
FIG. 3 is a side view of the ramp car shown in FIG. 2 in a lowered loading and unloading position.

A ramp car 20, shown in FIGS. 2 and 3, assists the loading and unloading of train 10. The use of a ramp car 20 avoids the need for extra side loading structure in cars 14. The ramp car 20 includes a lower ramp 22 and an upper ramp 24. The ramps may be attached to wheel sets 26 Which ride on tracks 28. During travel, upper and lower ramps 22 and 24 may be connected in a locked, raised travel position as shown in FIG. 2. For loading and unloading, the ramps 22 and 24 are lowered as shown in FIG. 3. In the raised travel position shown in FIG. 2, lower ramp 22 and upper ramp 24 must be locked together.

Figure 4:
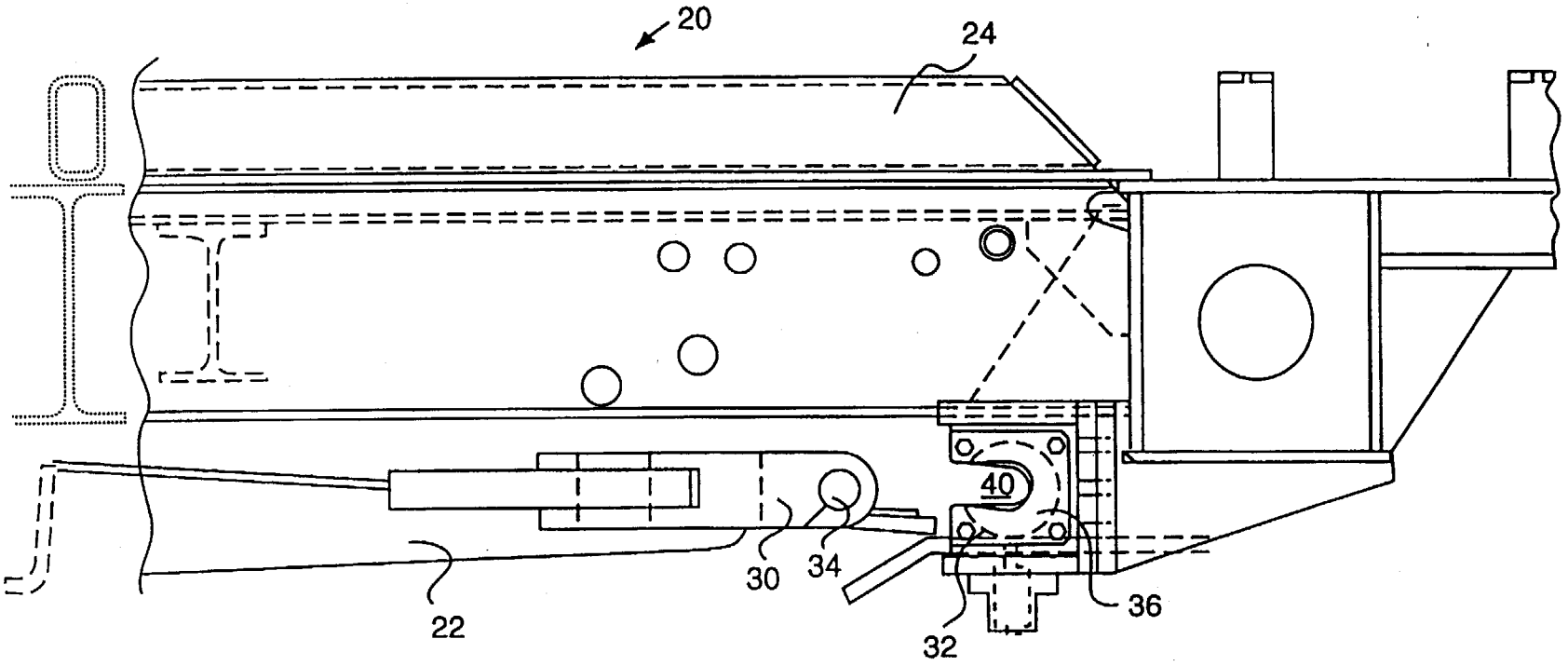
FIG. 4 is an enlarged fragmentary side view of an upper ramp and a lower ramp of the railway ramp car shown in FIG. 2 in a condition approaching coupling.

FIG. 4 shows lower ramp 22 and upper ramp 24 of railroad ramp car 20 in a raised, but unlocked position. FIG. 4 shows an enlarged view of area A of the railway ramp car shown in FIG. 2.

A yoke or pin carrier 30 and a rotor lock 32 engage to lock the lower ramp 22 and the upper ramp 24 in the raised, travel position. Pin carrier 30 is mounted to the nose of lower ramp 22 and supports a coupling pin 34. Rotor lock 32 is mounted to the underside of upper ramp 24. Rotor lock 32 supports two rotors or coupling disks 36 and 38. In FIG. 4, the coupling pin 34 is positioned to engage a rotor slot or groove 40 in each of the coupling disks 36 and 38.

Other mounting schemes are also possible within the spirit of this invention. For example, pin carrier 30 could be mounted to upper ramp 22 and rotor lock 32 could be mounted to lower ramp 22. The positions of pin carrier 30 and rotor lock 32 on the ramps could also be shifted.

Figure 5:
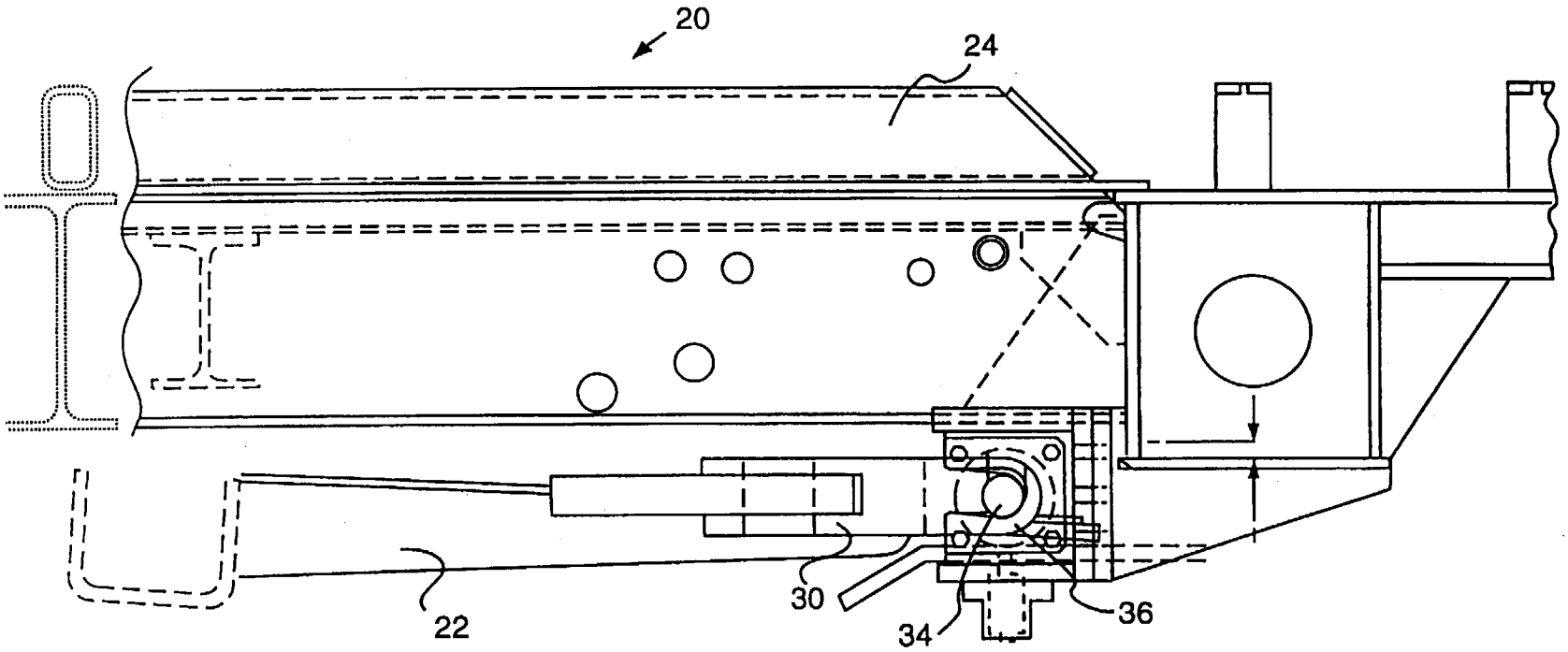
FIG. 5 is a side view of the upper and lower ramps shown in FIG. 4 in a raised, locked position.

FIG. 5 shows lower ramp 22 and upper ramp 24 of railway ramp car 20 in the raised, locked travel position. As shown in FIG. 5, coupling pin 34 has entered grooves 40 of coupling disks 36 and 38. The action of the coupling pin 34 entering grooves 40 of coupling disks 36 and 38 will rotate coupling disks 36 and 38 clockwise around a horizontal axis so that grooves 40 rotate from a horizontally projecting direction to a vertically projecting direction as will be described in more detail below with reference to FIGS. 16 and 17. The rotation of coupling disks 36 and 38 will lock lower ramp 22 and upper ramp 24 together.

Figure 6:
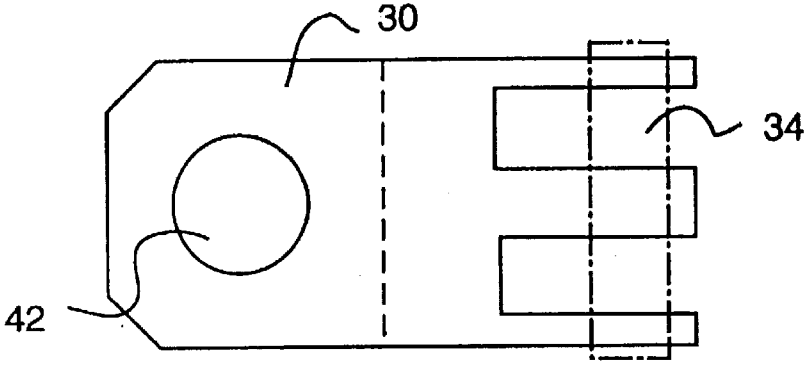
FIG. 6 is a top view of a pin carrier for use on the lower ramp shown in FIG. 4.
Figure 7:
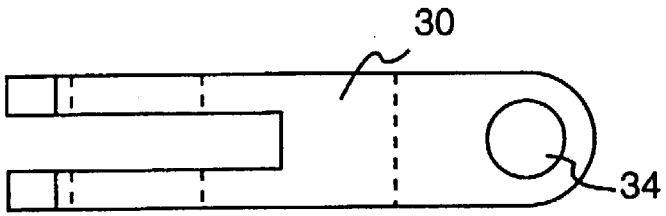
FIG. 7 is a side view of the pin carrier shown in FIG. 6.

As shown in FIGS. 6 and 7, pin carrier 30 supports the coupling pin 34 so that coupling pin 34 has an axis in the horizontal direction. The coupling pin 34 has a diameter of 2.00 or 2.25 inches, for example.

Figure 8:
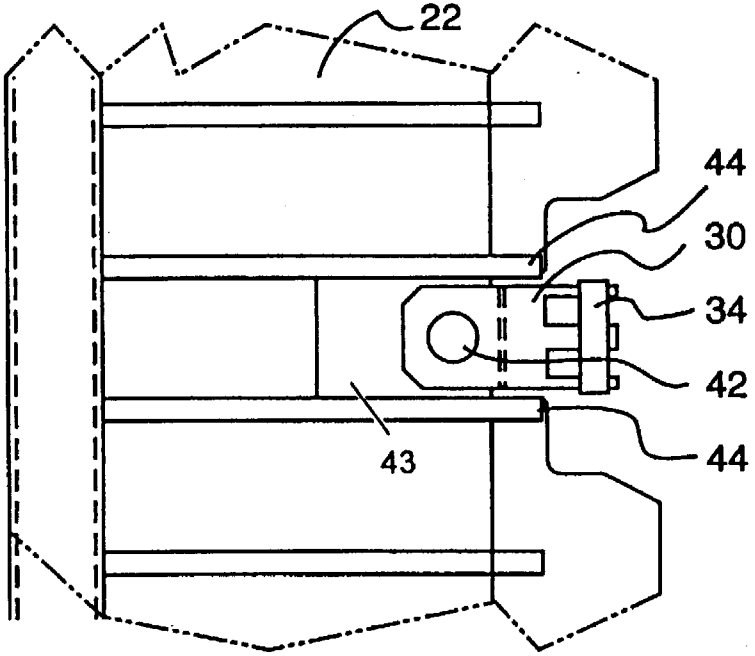
FIG. 8 is a top view of the pin carrier shown in FIGS. 6 and 7 mounted to a lower ramp.

A swivel pin 42 secures pin carrier 30 to lower ramp 22 as shown in FIG. 8. The swivel pin 42 also has a diameter sufficient to carry more than double the load of either disc and coupling pin, 2.82 or 3.18 inches, for example. Swivel pin 42 penetrates a heavy draft plate 43 which carries the longitudinal load out to the ramp structural members and into the main structure.

Because pin carrier 30 is mounted to lower ramp 22 by swivel pin 42, pin carrier 30 is free to pivot horizontally relative to lower ramp 22. The extent of pivoting is deliberately limited, for example, by the ramp structural members 44. Because the pin carrier 30 can pivot in the horizontal direction, the force on the coupling disks 36 and 38 is equalized despite a possible slight misalignment of lower ramp 22 to upper ramp 24. The maintenance of equal pressure on coupling disks 36 and 38 ensures load sharing between the two coupling disks 36 and 38 and a secure locking of lower ramp 22 to upper ramp 24. The full strength of both coupling disks 36 and 38 is used, and the full advantage of using two coupling disks is realized.

Figure 9:
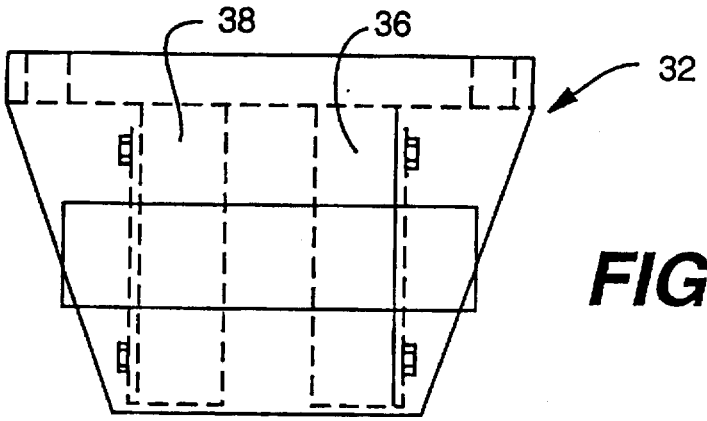
FIG. 9 is a top view of a rotor lock for use on the upper ramp shown in FIG. 4.
Figure 10:
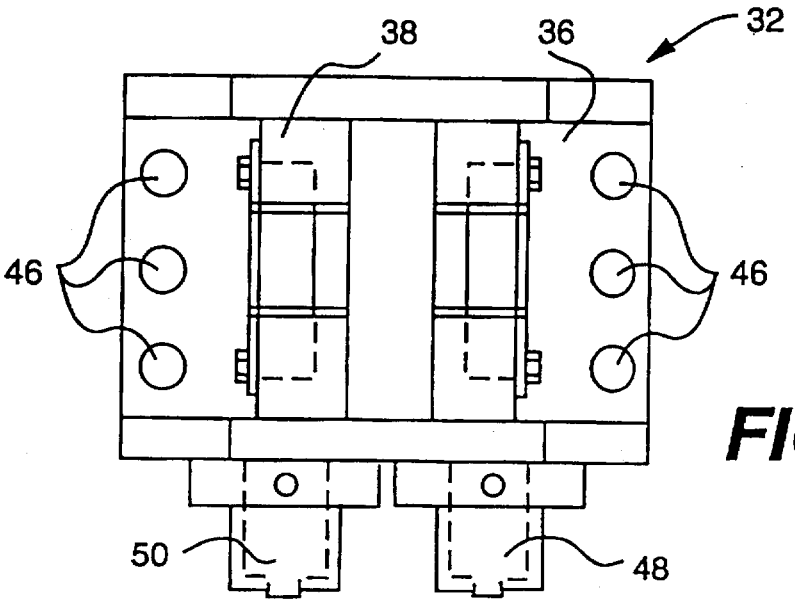
FIG. 10 is a front view of the rotor lock shown in FIG. 9.

The relative position of coupling disk 36 and coupling disk 38 mounted in rotor lock 32 is shown in FIGS. 9 and 10. Coupling disks 36 and 38 are preferably arranged in the vertical plane. Coupling disks 36 and 38 rotate around a horizontal axis preferably near but offset from the center of coupling disks 36 and 38.

A coupling disk could be placed in the horizontal plane. However, this would require a vertical pin at the narrow end of the lower ramp. A vertical pin could not project downward because of pavement getting in the way and could only project upward by an amount fixed by the clearance of the lowest part of a vehicle passing over it. Vertical projection of the pin would also be disadvantageous because of the difficulty of providing the swivel mechanism in the above mentioned restricted vertical envelope.

Figure 11:
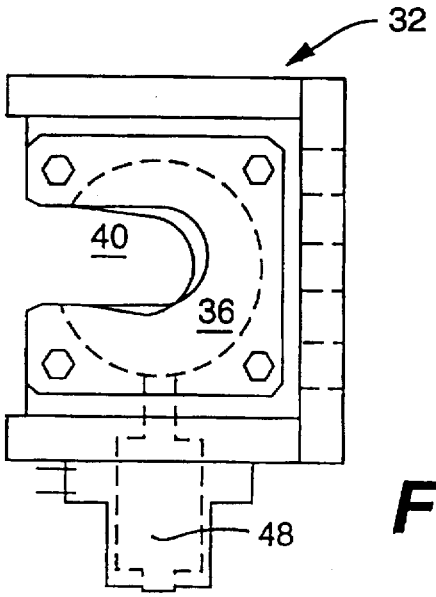
FIG. 11 is a side view of the rotor lock shown in FIGS. 9 and 10.

In FIG. 11, rotor lock 32 is shown with coupling disk 36 in the initial, unlocked position. Groove 40 of coupling disk 36 faces horizontally in a position to accept coupling pin 34. The coupling pin 34 shown in FIG. 7 will enter groove 40 in the position shown in FIG. 11.

Figure 12:
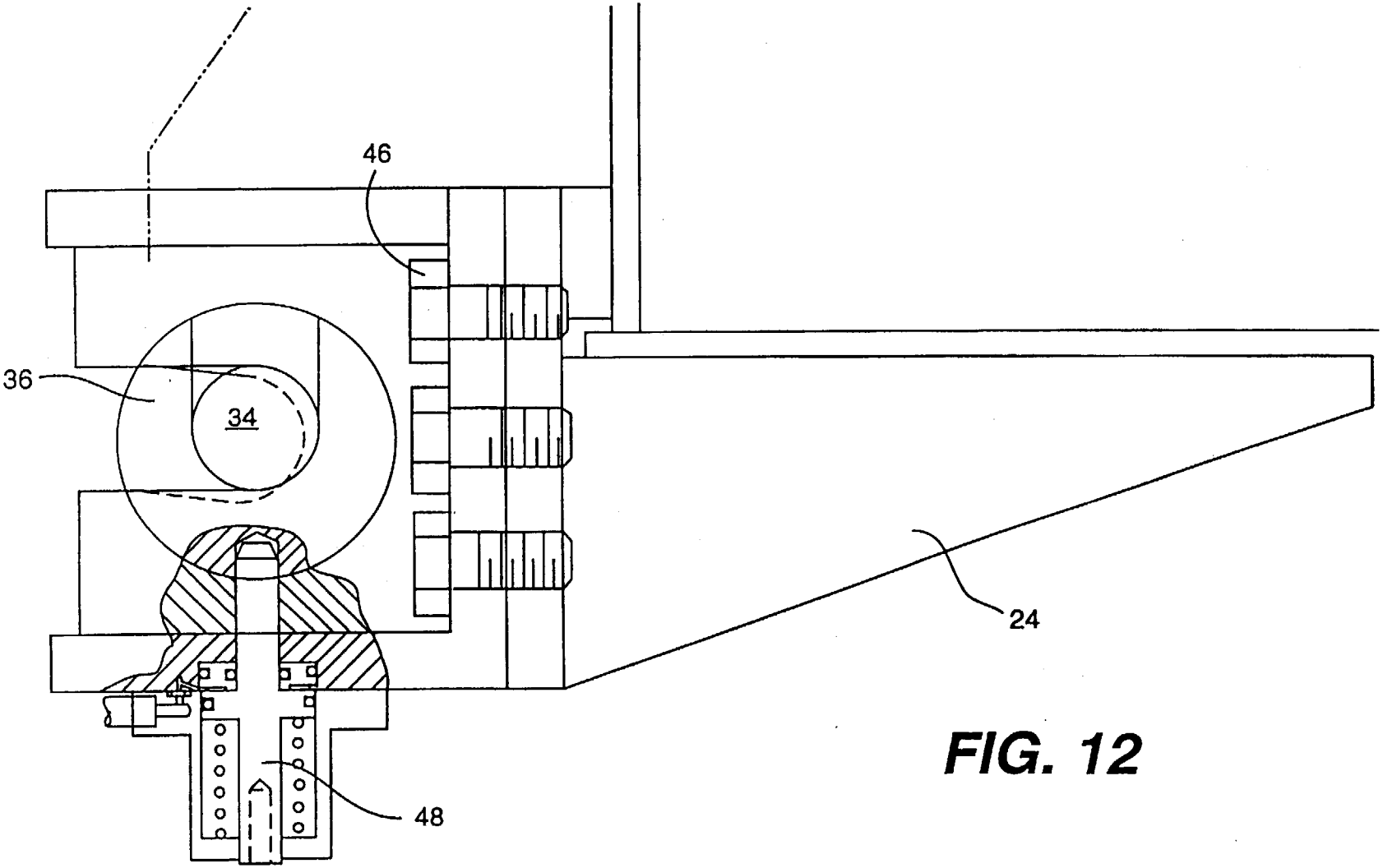
FIG. 12 is a side view of the rotor lock shown in FIGS. 9–11 mounted to an upper ramp.
Figure 13:
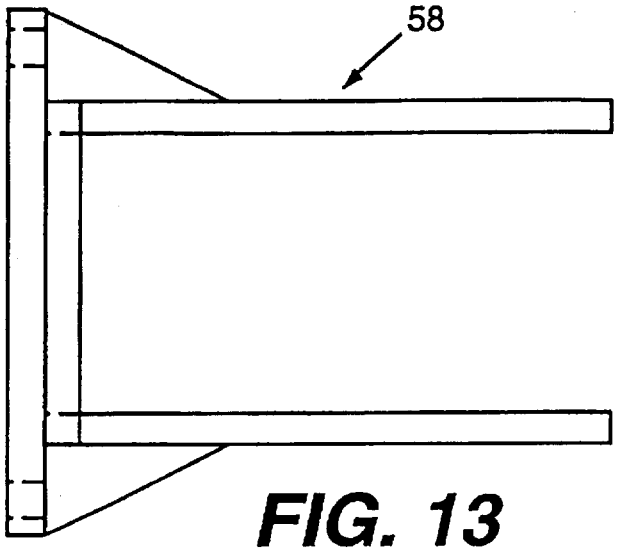
FIG. 13 is a top view of a mounting bracket for securing the rotor lock shown in FIGS. 9–11 to the upper ramp as shown in FIG. 12.
Figure 14:
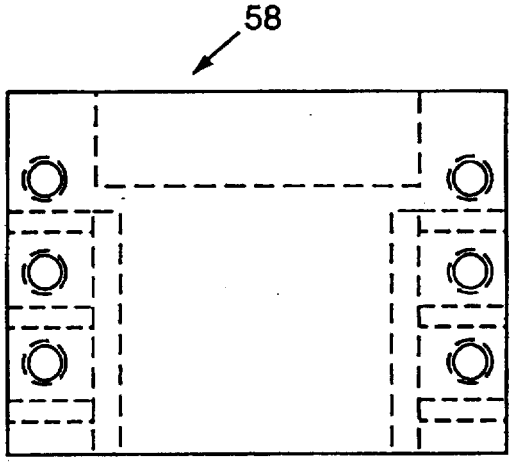
FIG. 14 is a front view of the mounting bracket shown in FIG. 13.
Figure 15:
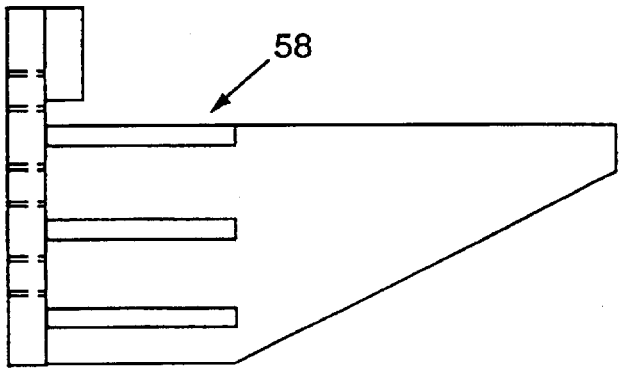
FIG. 15 is a side view of the mounting bracket shown in FIGS. 13 and 14.

Rotor lock 32 is preferably secured to upper ramp 24 by six bolts 46 as shown in FIGS. 10 and 12. FIGS. 13, 14, and 15 show a mounting bracket 58 for securing the rotor lock 32 to the upper ramp 24. The rotor lock 32 is easily attached or detached from upper ramp 24 by removing bolts 46. Previous ramp couplers were welded integral assemblies with the upper ramp 24.

Figure 16:
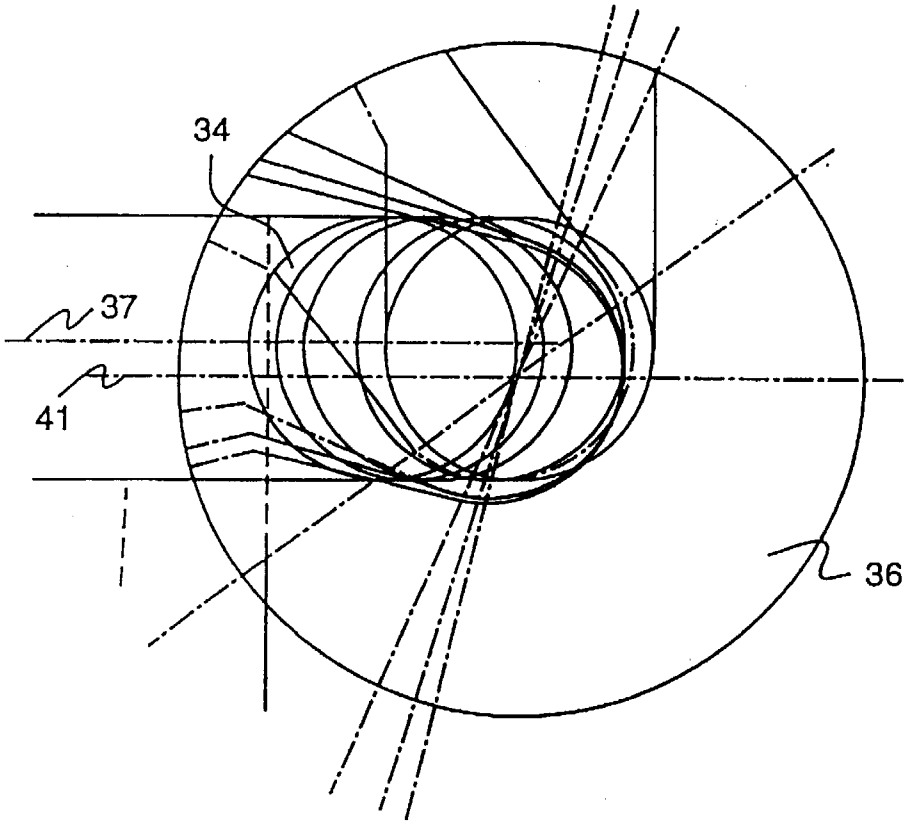
FIG. 16 is a schematic side view of a coupling pin entering a coupling disk.

FIG. 16 shows the rotor lock kinematics as coupling pin 34 enters groove 40 in coupling disk 36. In the initial position, groove 40 is horizontal facing the left side of the page, while in the final position, groove 40 is vertical facing the top of the page. Groove 40 may also face downward in the locked position within the spirit of this invention. The coupling disks 36 and 38 would rotate counter clockwise as coupling pin 34 enters grooves 40.

As shown in FIG. 16, groove 40 and coupling disk 36 are eccentric. Radius 37 of coupling disk 36 is offset from the radius 41 of groove 40. This offset will create a torque on coupling disk 36 as coupling pin 34 enters groove 40.

The locking procedure will now be described. As coupling pin 34 progresses into coupling disks 36 and 38, the coupling disks 36 and 38 are forced to turn in a clockwise direction around a horizontal axis until, at the final position, grooves 40 of coupling disks 36 and 38 stand vertically.

As coupling pin 34 is forced into rotor lock 32, coupling pin 34 may cock left or right slightly on swivel pin 42. When coupling pin 34 abuts the rear of one of grooves 40, whichever end of coupling pin 34 abuts first will provide a force on pin carrier 30 about swivel pin 42 and cause the not yet abutted end of coupling pin 34 to move forward until it too is bottomed in its groove 40 of coupling disk 36 or 38. Thus, both coupling disks 36 and 38 are rotated into the closed position, and when a longitudinal load is applied to the locked assembly, this load will be divided essentially equally between the two coupling disks 36 and 38.

A latch engaging coupling disks 36 and 38 in the closed position will prevent withdrawal of coupling pin 34 with a considerable mechanical advantage given by both the lever ratio of the lock groove offset divided by the rotor radius and strengthened by the friction of the rotor surface resisting rotation.

As shown in FIGS. 11 and 12, when coupling disk 36 is in the locked position, a detent pin 48 engages coupling disk 36 to secure coupling disk 36 into the locked position. Likewise, a detent pin 50 will engage coupling disk 38. Detent pins 48 and 50 are preferably pneumatically actuated with an emergency manual override, to permit operation in the absence of air. Coupling disk 36 shown in FIG. 12 is in the locked position securing coupling pin 34. Detent pin 48 has been raised to engage coupling disk 36 to secure coupling disk 36 into the locked position.

Detent pins 48 and 50 may be spring biased so as to automatically engage coupling disks 36 and 38 when coupling disks 36 and 38 are in the locked position.

Figure 17:
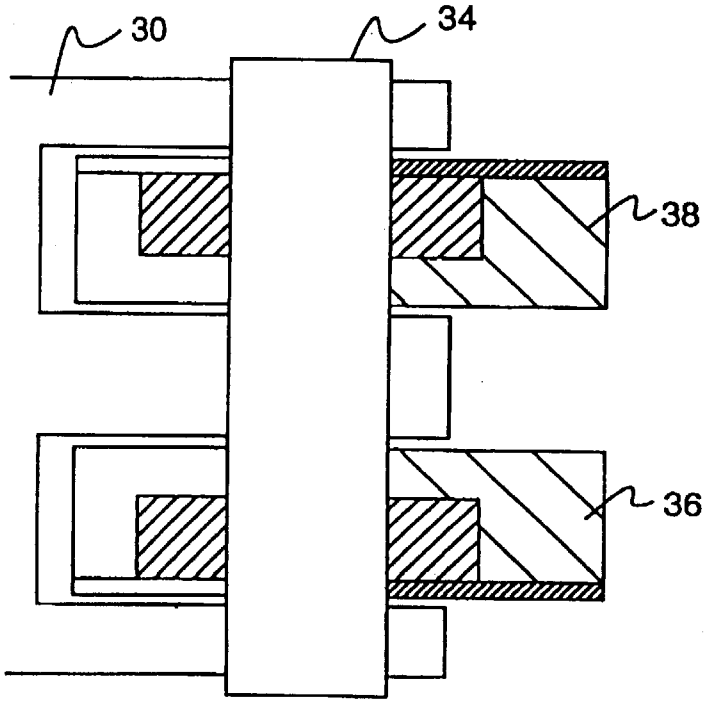
FIG. 17 is a top view of a coupling pin secured by two coupling disks.

Referring to FIG. 17, a sample stress calculation for example dimensions of the rotor lock are provided. The stress calculation assumes a 300,000 lb. load and a coupling pin diameter of 2.25 inches. If a pin of 2.00 inch diameter is used, the calculation will be altered slightly.

Shear Area=3.974

Lever Arm 1"

Max Load 75,000 lb (¼ of total)

Section Modulous=1.25

$Sb=(75{,}000\times1)\times1/1.25=60{,}000$ $Ss=75{,}000/3.95=18{,}987$

Combined Stress=$\sqrt{Sb^2+Ss^2}$=62,900 Psi for 300,000 lb. Load in Quadruple Shear With the above geometry, the radial load on detent pins 48 and 50 resulting from any tractive force is only 1/20th of that force. Thus, the force to withdraw one pin is only 1/40th of the draft force times the friction coefficient of the pin and its bearing surface (normally, with lubrication about 0.1). Thus, the force to withdraw one pin is:

$F=0.1\times(\text{draft force})\times1/40$ or $F=0.0025\times\text{draft force}$ The force available on a 2½ inch diameter direct acting uncoupling cylinder from 100 PSI of air (supplied from the main reservoir via the main reservoir trainline) is:

$100\times\pi/4\times(2.25)^2=357$ lb.

The coupler will uncouple without "taking slack" at static draft forces up to:

357/0.0025=158,900 lb.

The load expected to be "locked up" in a train standing still with brakes applied is much lower than 158,900 lb. (A worse case example having brakes on ½ of an element locked and being pushed or pulled through the coupling against fully applied brakes would produce a draft force of only 30,000 lb.). Thus, assuring proper operation of the uncoupling device without the need for complex mechanical advantages. This simplifies the structure of the lock.

With the above described lock, the coupling of the lower ramp to the upper ramp is certain and automatic. In addition, the lock simplifies the mechanical construction of the lock and eliminates the need for complex mechanical advantages. The lock is also self cleaning.

In a second embodiment of the invention, the pin carrier is mounted to a ramp by a cushioning or shock absorbing device. Alternatively, the rotor lock may be mounted to a ramp by a cushioning or shock absorbing device, or both the rotor lock and the pin carrier may be mounted by cushioning or shock absorbing devices. However, a single device can provide any amount of desired cushioning while maintaining the greatest simplicity.

Figure 18:
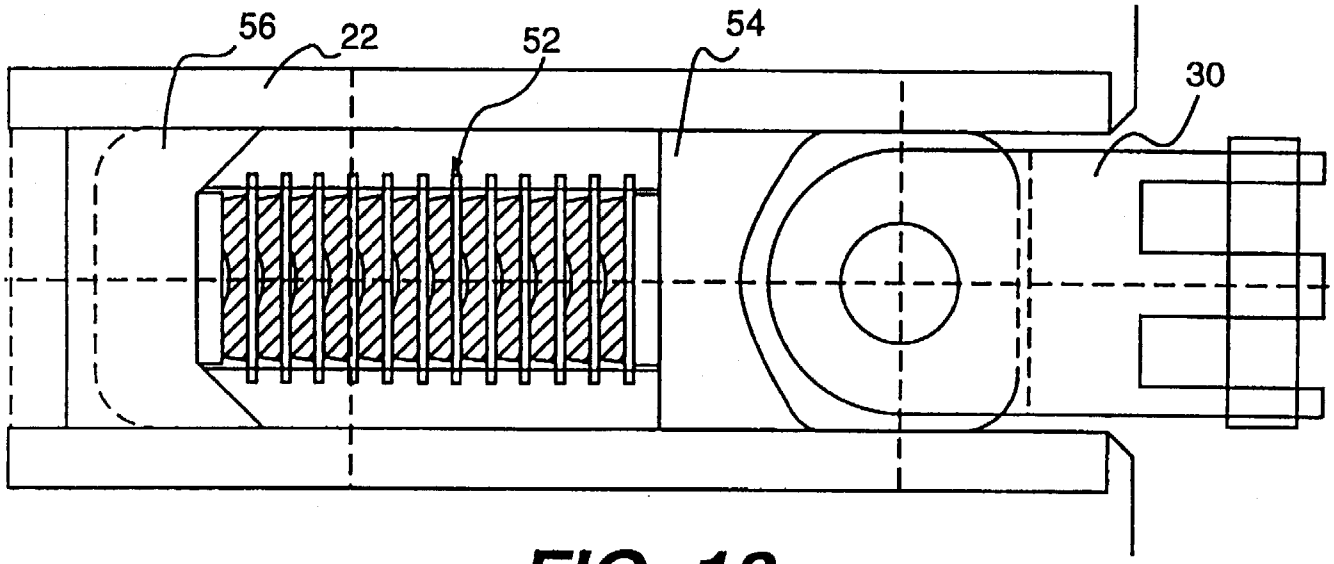
FIG. 18 is a top view of a coupling pin mounted to a lower ramp according to a second embodiment of the invention.
Figure 19:
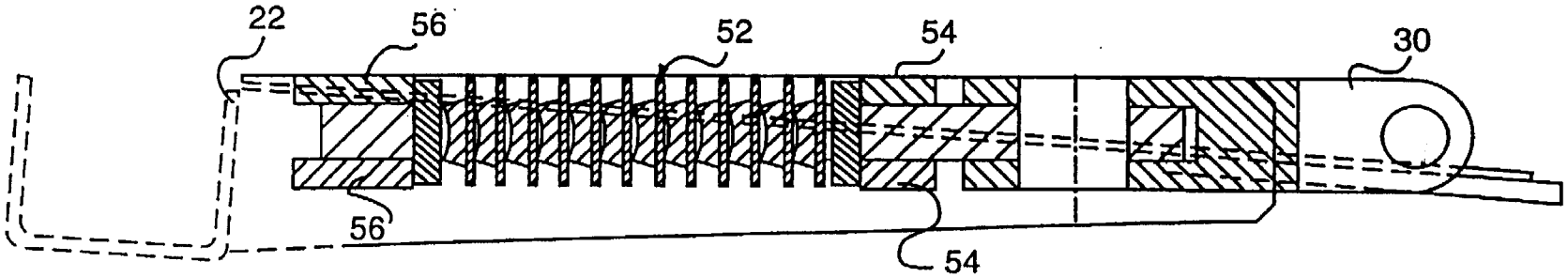
FIG. 19 is a side view of the coupling pin mounting shown in FIG. 18.

FIG. 18 shows a top view and FIG. 19 shows a side view of a pin carrier 30 mounted to a lower ramp 22 according to a second embodiment of the invention. A draft cushion 52 is interposed between pin carrier 30 and the lower ramp 22.

As seen in FIGS. 13 and 14, the heavy draft plate is not welded between the ramp structural members. Instead, it is slidably mounted to the ramp structural members. An outer draft stop 54 and an inner draft stop 56 bridge these members and provide a pocket in which a sliding draft yoke may be carried. When the draft yoke is slid into place in this pocket and draft cushion 52 is assembled in the opening in the yoke, pin carrier 30 cannot be pushed or pulled away from the lower ramp 22 without compressing the several rubber mats which comprise draft cushion 52.

Cushioning can be characterized to fit the load by selecting the correct type, thickness, and number of mats in the draft cushion 52.

Figure 20:
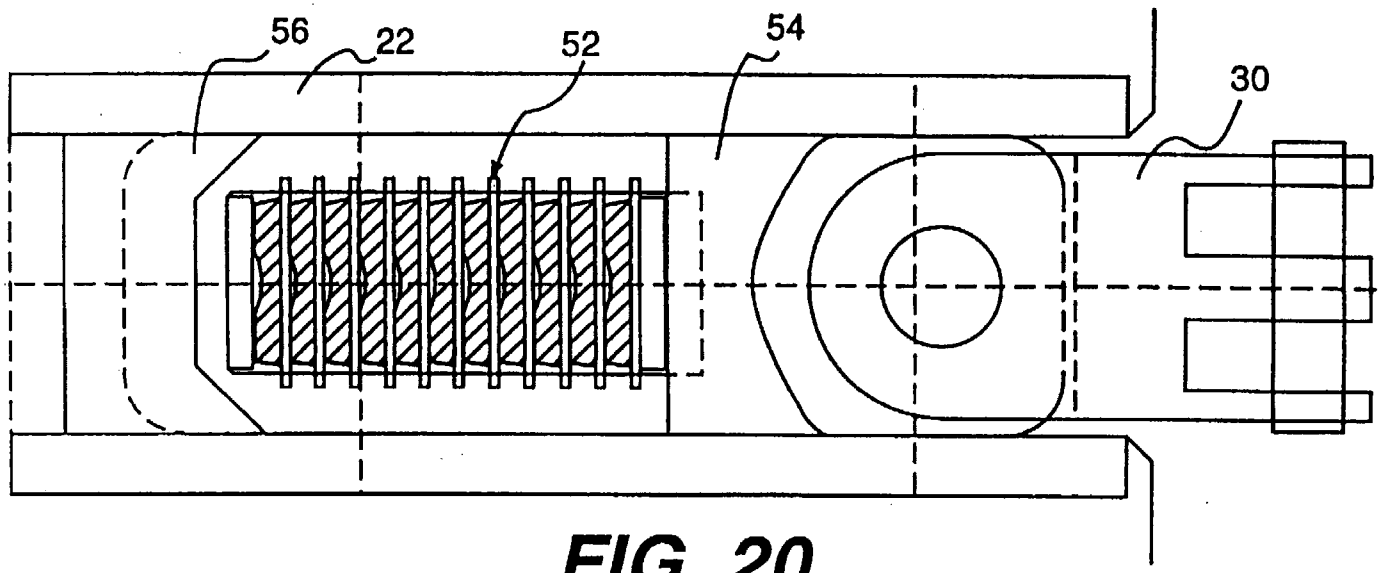
FIGS. 20 and 21 are similar to FIGS. 18 and 19 except that in FIGS. 20 and 21, a draft force is exerted tending to extend the coupling arrangement.
Figure 21:
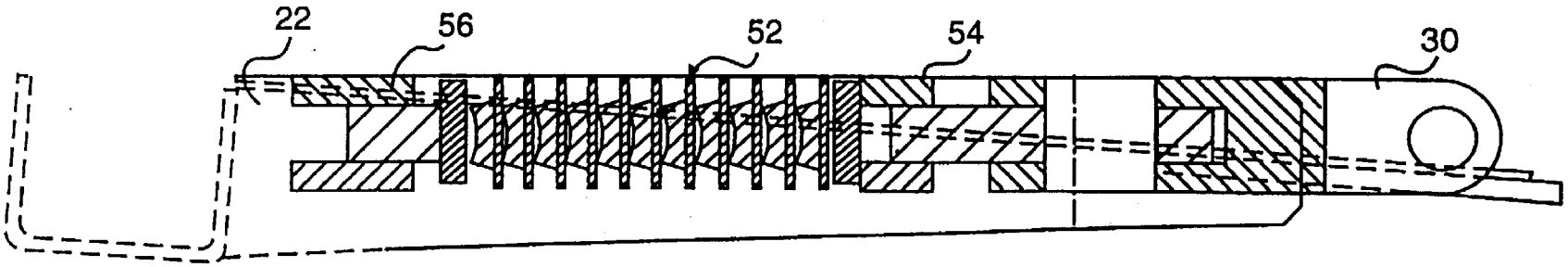

FIGS. 20 and 21 are similar to FIGS. 18 and 19 except that in FIGS. 20 and 21, the position of the parts when a draft force is exerted tending to extend the coupling arrangement is shown.

Figure 22:
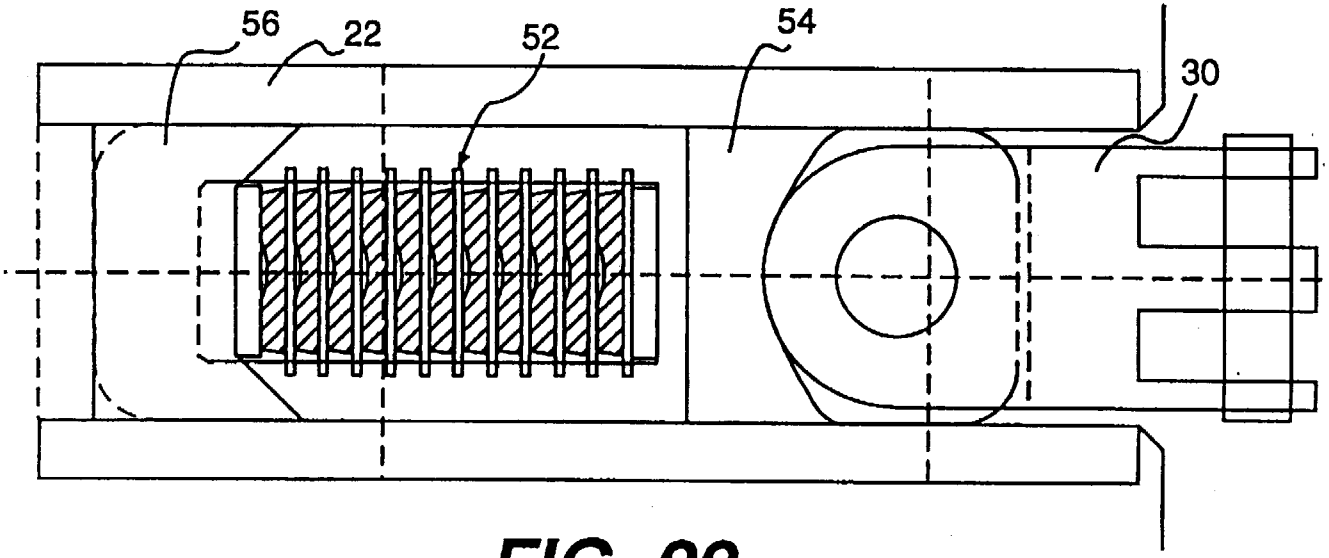
FIGS. 22 and 23 are also similar to FIGS. 18 and 19 except that in FIGS. 22 and 23, a buff force is imposed on the coupling arrangement.
Figure 23:
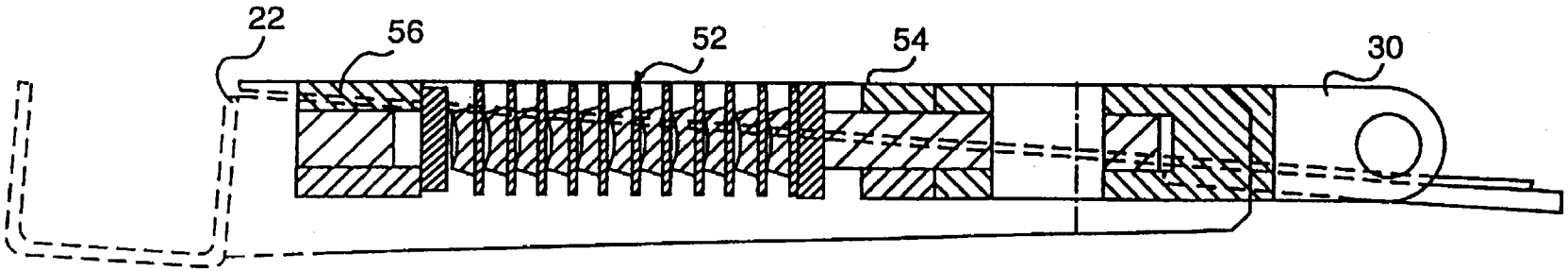

FIGS. 22 and 23 are also similar to FIGS. 18 and 19 except that in FIGS. 22 and 23, the position of the parts resulting when a buff force is imposed on the coupling arrangement is shown.

Figure 24:
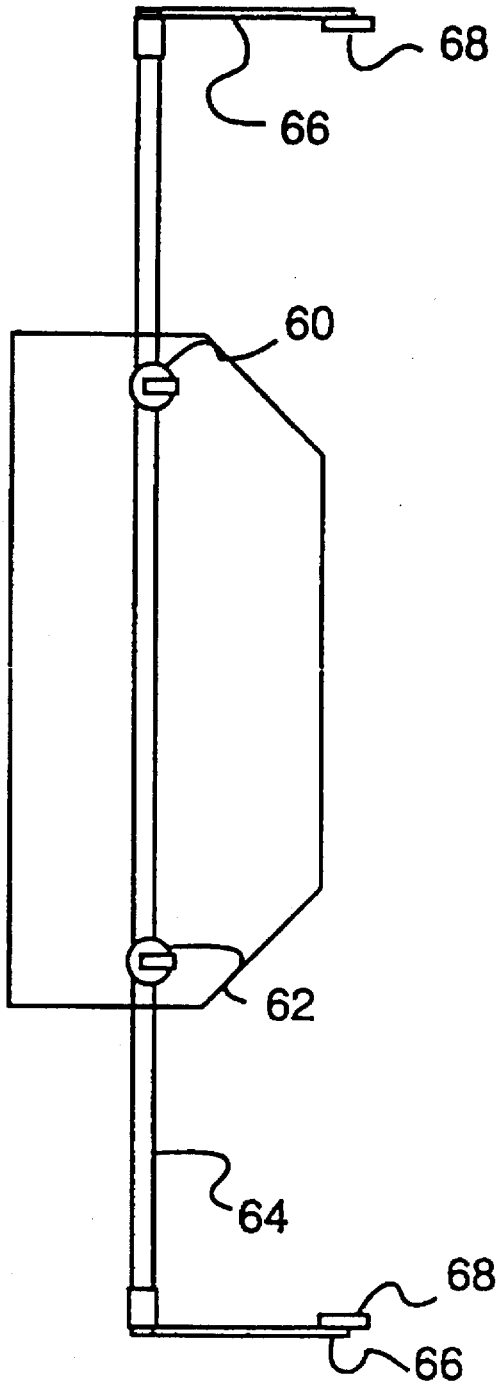
FIG. 24 is a top view of a safety latch which may be attached to the railway ramp car.

The railway ramp car may optionally include a manual safety lock. The safety lock may be mounted to the upper ramp 24. As shown in FIG. 24, the safety lock includes two pins 60 and 62 connected to an operating rod 64. Operating levers 66 rotate the operating rod 64 to move the safety pins 60 and 62 up and down. The operating rod 64 runs the entire width of the ramp car 20 so that the safety lock can be operated from either side of the ramp car 20.

Figure 25:
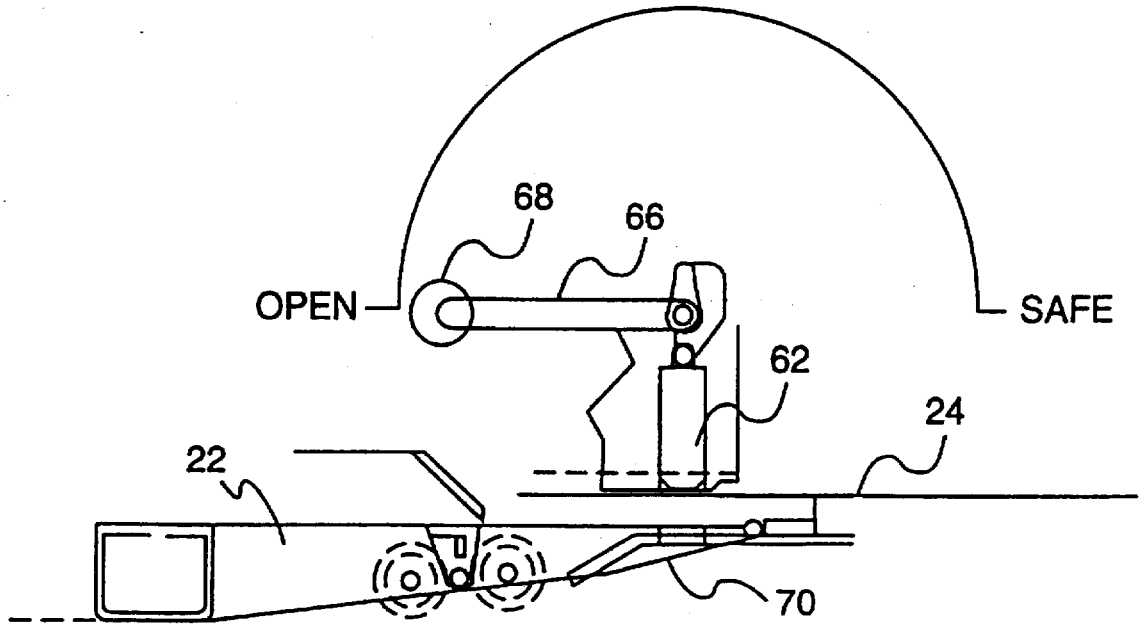
FIG. 25 is a side view of the safety latch shown in FIG. 24 in the open position.
Figure 26:
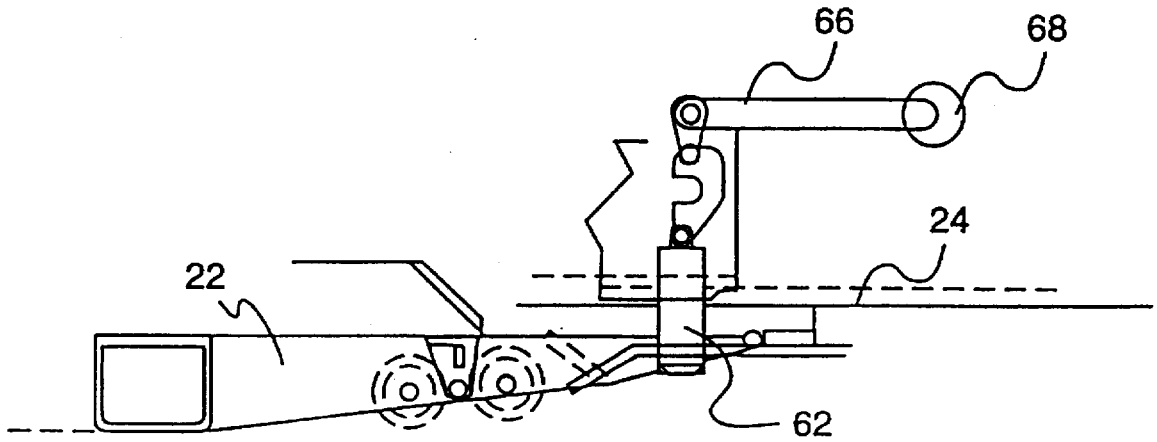
FIG. 26 is a side view of the safety latch shown in FIG. 24 in the closed, safe position.

FIG. 25 shows the safety lock in the open, uncoupled position, while FIG. 26 shows the safety lock in the safe, coupled position. In the safe, coupled position, the pin 62 mounted on the upper ramp 24 engages a pin hole 70 in the lower ramp 22. Once the pin 62 is seated in the pin hole 70, the upper ramp 24 and lower ramp 22 cannot move apart from each other, thus providing a safety lock.

The pin hole 70 preferably has a greater diameter than the safety pins 60 and 62. The diameter difference may be, for example, one-half inch. Thus, the safety pins 60 and 62 will not be loaded unless the main rotor lock coupler fails.

The foregoing description of preferred embodiments of the invention has been presented for purposes of illustration and description. It is not intended to be exhaustive or to limit the invention to the precise form disclosed, and obviously many modifications and variations are possible in light of the above teachings or may be acquired from practice of the invention. The embodiments were chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A railway ramp car, comprising:

a first wheel set and a second wheel set;

a first ramp mounted to the first wheel set and a second ramp mounted to the second wheel set, at least one of the first and second ramps having a raised travel position and a lowered loading position;

a pin carrier mounted on the first ramp, the pin carrier supporting a coupling pin having a horizontal axial direction; and a rotor lock mounted on the second ramp, the rotor lock comprising first and second coupling disks having grooves for receiving the coupling pin.

2. A railway ramp car as claimed in claim 1 wherein the coupling disks are mounted vertically with a horizontal axis of rotation.

3. A railway ramp car as claimed in claim 1, further comprising means for pivotally mounting the pin carrier to the first ramp.

4. A railway ramp car as claimed in claim 3, wherein the means for pivotally mounting comprises a swivel pin mounted on the first ramp, the swivel pin having a vertical axial direction and the swivel pin supporting the pin carrier so that the pin carrier can pivot relative to the first ramp.

5. A railway ramp car as claimed in claim 4, wherein the first wheel set is attached to one end of the first ramp and the means for pivotally mounting is attached to the other end of the first ramp and wherein the second wheel set is attached to one end of the second ramp and the rotor lock is attached to the second ramp between the wheel set and the other end of the second ramp.

6. A railway ramp car as claimed in claim 3, further comprising means for locking the first and second coupling disks into a position holding the coupling pin.

7. A railway ramp car as claimed in claim 6, wherein the means for locking comprises first and second detent pins for engaging apertures in the first and second coupling disks, respectively.

8. A railway ramp car as claimed in claim 1, further comprising means for mounting the pin carrier to the first ramp and for providing cushioning between the pin carrier and the first ramp.

9. A railway ramp car as claimed in claim 1, further comprising means for removably mounting the rotor lock to the second ramp.

10. A railway ramp car as claimed in claim 1, further comprising means for providing cushioning between the rotor lock and the second ramp.

11. A railway ramp car as claimed in claim 1, further comprising means for locking the first and second coupling disks into a position holding the coupling pin.

12. A railway ramp car, comprising:

a first wheel set and a second wheel set;

a first ramp mounted to the first wheel set and a second ramp mounted to the second wheel set, at least one of the first and second ramps having a raised travel position and a lowered loading position;

a pin carrier supporting a coupling pin having a horizontal axial direction;

means for pivotally mounting the pin carrier on the first ramp; and a rotor lock mounted on the second ramp, the rotor lock receiving the coupling pin and locking the first and second ramps together.

13. A railway ramp car as claimed in claim 12, further comprising means for removably mounting the rotor lock to the second ramp.

14. A railway ramp car as claimed in claim 12, further comprising means for providing cushioning between the rotor lock and the second ramp.

15. A railway ramp car as claimed in claim 12, wherein the means for pivotally mounting comprises a swivel pin mounted on the first ramp, the swivel pin having a vertical axial direction and the swivel pin supporting the pin carrier so that the pin carrier can pivot relative to the first ramp.

16. A railway ramp car as claimed in claim 15, wherein the first wheel set is attached to one end of the first ramp and the means for pivotally mounting is attached to the other end of the first ramp and wherein the second wheel set is attached to one end of the second ramp and the rotor lock is attached to the second ramp between the wheel set and the other end of the second ramp.

17. A railway ramp car as claimed in claim 12, wherein the rotor lock comprises first and second coupling disks having grooves for receiving the coupling pin.

18. A railway ramp car as claimed in claim 17, further comprising means for locking the first and second coupling disks into a position holding the coupling pin.

19. A railway ramp car as claimed in claim 18, wherein the means for locking comprises first and second detent pins for engaging apertures in the first and second coupling disks, respectively.

20. A train including a plurality of rail cars and a ramp car connected to each other, the ramp car including a ramp on a first portion of the ramp car removably received in a locking area on a second portion of the ramp car and locked thereto in a raised travel position of the ramp by a locking means, the ramp having a lowered loading position for providing access for vehicles to the train when the ramp is separated from the second portion of the ramp car, the locking means comprising:

a pivoting coupling pin carrier supporting a coupling pin, the coupling pin carrier being on one of the first and second portions of the ramp car; and a rotor lock on the other of the first and second portions of the ramp car, the rotor lock comprising first and second coupling disks having grooves for receiving the coupling pin and locking the ramp.

* * * * *